US006955552B2

(12) United States Patent
Ferri et al.

(10) Patent No.: US 6,955,552 B2
(45) Date of Patent: Oct. 18, 2005

(54) ADAPTER FOR PORTABLE ELECTRONIC INSTRUMENT AND TRANSMISSION SYSTEM BETWEEN THESE TWO ELEMENTS

(75) Inventors: Yvan Ferri, Lausanne (CH); Yves Oesch, Neuchâtel (CH)

(73) Assignee: Asulab S.A., (CH)

( * ) Notice: Subject to any disclaimer, the term of this patent is extended or adjusted under 35 U.S.C. 154(b) by 0 days.

(21) Appl. No.: 10/948,033

(22) Filed: Sep. 23, 2004

(65) Prior Publication Data

US 2005/0064751 A1 Mar. 24, 2005

(30) Foreign Application Priority Data

Sep. 23, 2003 (EP) ..... 03021457

(51) Int. Cl.[7] ..... H01R 29/00

(52) U.S. Cl. ..... 439/188; 439/500; 439/259; 439/76.1; 200/51.09; 368/204; 368/321

(58) Field of Search ..... 439/188, 259, 439/500, 660, 668, 76.1; 200/51.09, 51.1; 368/319, 320, 321, 204, 187; 320/113, 115; 429/97

(56) References Cited

U.S. PATENT DOCUMENTS 6,319,034 B1 * 11/2001 Takakura et al. ..... 439/310
6,396,771 B2 * 5/2002 Paratte ..... 368/203
6,454,608 B1 * 9/2002 Kitahara et al. ..... 439/638
6,527,584 B2 * 3/2003 Ninomiya ..... 439/500
6,625,087 B2 * 9/2003 Paratte ..... 368/69
6,700,083 B2 * 3/2004 Konda ..... 200/51.09
6,846,998 B2 * 1/2005 Hasumi et al. ..... 200/341
6,854,978 B2 * 2/2005 Noirjean ..... 439/37
6,890,682 B2 * 5/2005 Takahashi et al. ..... 429/97

FOREIGN PATENT DOCUMENTS

EP 1 109 084 6/2001
EP 1 134 630 9/2001
EP 1 302 822 4/2003

* cited by examiner

*Primary Examiner*—P. Austin Bradley
*Assistant Examiner*—X. Chung-Trans
(74) *Attorney, Agent, or Firm*—Richard K Robinson

(57) ABSTRACT

The invention concerns an adaptor (100) adapted to establish an electric connection with a portable electronic instrument (200) and to allow transmission of electric signals. The portable instrument is controlled via at least one control member (210) having first electric contact means (213) accessible from the exterior of the instrument. The control member is capable of occupying a first non pushed-in position and a second pushed-in position. The adaptor includes a support (101) having a pattern cavity (102) dimensioned to receive the instrument. The pattern cavity includes at least one housing (110) in which are arranged second electric contact means (119). The housing is dimensioned to receive the control member, such that, on the one hand, the control member is brought into the pushed-in position and, on the other hand, the first and second electric contacts are brought into contact, when the instrument is placed in the pattern cavity.

18 Claims, 4 Drawing Sheets

ADAPTER FOR PORTABLE ELECTRONIC INSTRUMENT AND TRANSMISSION SYSTEM BETWEEN THESE TWO ELEMENTS

This application claims priority from European Patent Application No. 03021457.1 filed Sep. 23, 2003, the entire disclosure of which is incorporated herein by reference.

FIELD OF THE INVENTION

The present invention concerns generally, a system for transmitting electric signals between a portable electronic instrument and an adaptor, such as for example, between a watch and a charger, or between a watch and a communication interface connected to an external communication unit, such as a personal computer. The invention concerns more particularly the means for establishing an electric connection between the portable electric instrument and the adaptor for transmitting electric signals from and/or to the portable instrument.

BACKGROUND OF THE INVENTION

Means for recharging the accumulator and respectively for charging or extracting data from a portable electronic instrument, such as a watch, are known in the prior art, particularly from EP Patent Application No. 1 109 084 and EP Patent Application No. 1 134 630. In these two documents, the watch a case containing an electronic module controlled via at least one control member having electric contact means accessible from outside the case. The control member is capable of occupying a first non pushed-in position in which no electric connection is established between the electric contact means and the electronic module and a second pushed-in position in which an electric connection is established between the electric contact means and the electronic module.

In EP Patent Application No. 1 109 084, the watch is powered by a rechargeable accumulator and includes two control members for controlling the horological functions, each of the control members being connected to a respective pole of the accumulator after pressure on said members.

In EP Patent Application 1 134 630, the watch includes an internal electronic unit and at least one control member for controlling a horological function, the control member also being used to transmit and/or receive data with an external communication unit such as a personal computer.

In the two aforementioned documents, no mention is made of the adaptation means used to make the interface between the watch and the charger or the personal computer.

There is known from the prior art, particular from U.S. Pat. No. 6,319,034, the use of a communication interface between a portable electronic instrument and an external communication unit. This communication interface includes a support having a cavity for receiving the portable instrument. The cavity is wider than the instrument and has, on one side, an elastic surface and, on the other side, a mobile element that can be manually actuated so as to compress the portable instrument between the elastic surface and the mobile element. In order to transmit data between the communication interface and the portable instrument, the mobile element is provided with connection elements that plug into terminals of the instrument provided specifically for that purpose.

However, such a communication interface has certain drawbacks. Thus, the use of a manually actuated mobile element requires, on the one hand, means for actuating said mobile element which prove complex and expensive and, on the other hand, particular care by the user to ensure the electric connection between the communication interface and the portable instrument is properly established. It will also be noted that since the connection elements are carried by the mobile element, the connection terminals have to be arranged in the same zone, which causes expensive manufacturing constraints for the instrument.

Moreover, as mentioned hereinbefore, the connection terminals used are specifically provided for communications between the portable instrument and the interface, which imposes, on the one hand, constraints as regards the arrangement of the conventional control members, and which raises, on the other hand, additional problems of sealing as regards the case of the portable instrument. One solution, which would consist in using the control members described in EP Patent Application No. 1 109 084 and EP Patent Application No. 1 134 630 is undesirable insofar as it would require providing an even more complex mobile element, or even several mobile elements depending upon the distribution of the control members.

SUMMARY OF THE INVENTION

It is an object of the present invention to overcome the aforementioned drawbacks. This is why it is thus a general object of the present invention to propose a system for transmitting electric signals between a portable electronic instrument and an adaptor for assuring a simple electric connection, requiring no particular construction as regards the portable instrument, while assuring a simple and inexpensive adaptor construction, requiring no mobile connection means or means arranged on a mobile element, to effect said electric connection.

The present invention thus concerns a system for transmitting electric signals of the aforementioned type whose features are set out in claim 1.

The invention also concerns an adaptor for such a system, whose features are set out in claim 6.

Advantageous embodiments of the present invention form the subject of the dependent claims.

The proposed solution for the transmission system consists in providing, on the one hand, a portable electric instrument capable of transmitting electric signals via its conventional control members and, on the other hand, an adaptor having a pattern cavity dimensioned to receive the control members of the portable instrument such that the control members used for transmitting electric signals are in the pushed-in position, while assuring an electric connection between the instrument and the adaptor, when the instrument is placed in the pattern cavity According to a preferred aspect of the invention, the pattern cavity of the adaptor includes one or several housings dimensioned to receive the control members of the portable instrument. These housings advantageously have, from top to bottom, a guide surface for bringing the watch into position, a support surface for bringing the control members into their pushed-in position and electric contact means, preferably in the form of a flexible metal strip arranged in a cavity, for contacting the electric contact means of the control member that are accessible outside.

BRIEF DESCRIPTION OF THE DRAWINGS

Other features and advantages of the present invention will appear more clearly upon reading the following detailed description of various embodiments of the invention given solely by way of non-limiting examples and illustrated by the annexed drawings, in which.

DESCRIPTION OF PREFERRED EMBODIMENTS

As already mentioned, the invention proceeds from the general idea that consists in connecting a portable electronic instrument (for example a wristwatch) to an external electrical or electronic device via at least one control member of the user interface with which the portable electronic instrument is fitted. "Transmission of electric signals" will cover in particular the application of electric signals for the purpose of recharging an electric accumulator with electrical energy and the communication of data to and/or from the portable electronic instrument. The external device can thus be an electrical charging device for the accumulator or a communication interface with an electronic communication device, for example a personal computer. In the following description, this electric charging device and/or this communication interface, will be called an adaptor, insofar as the charger and/or the communication interface allow the portable electronic instrument to be adapted to a different use to that initially provided.

Within the scope of the present invention, it will be understood that the control member or members of the portable electronic instrument are configured to fulfil two functions, namely their first control function for selecting functions of the portable electronic instrument (selection of operating or data modes, data or parameter updating for the portable electronic instrument, for example the time and/or the date setting, etc.) and the additional function of means for transmitting electric signals via electric contact means accessible from outside the watch.

It will also be understood that the transmission of electric signals (for example for recharging an accumulator and/or data communication) can be established as soon as the control member or members configured for this purpose are brought into the pushed-in position. Connection of the portable electronic instrument to the external electrical or electronic device will thus be established owing to an adaptor arranged for bringing the control members concerned into the pushed-in position.

The present invention will be described with reference to a transmission system between a timepiece advantageously taking the form of a wristwatch and an adaptor advantageously taking the form of a wristwatch support. The invention nonetheless applies in an identical manner to any portable electronic instrument whether or not it fulfils a horological function, as well as to any adaptor whether or not it fulfils a support function.

Figure 1A:
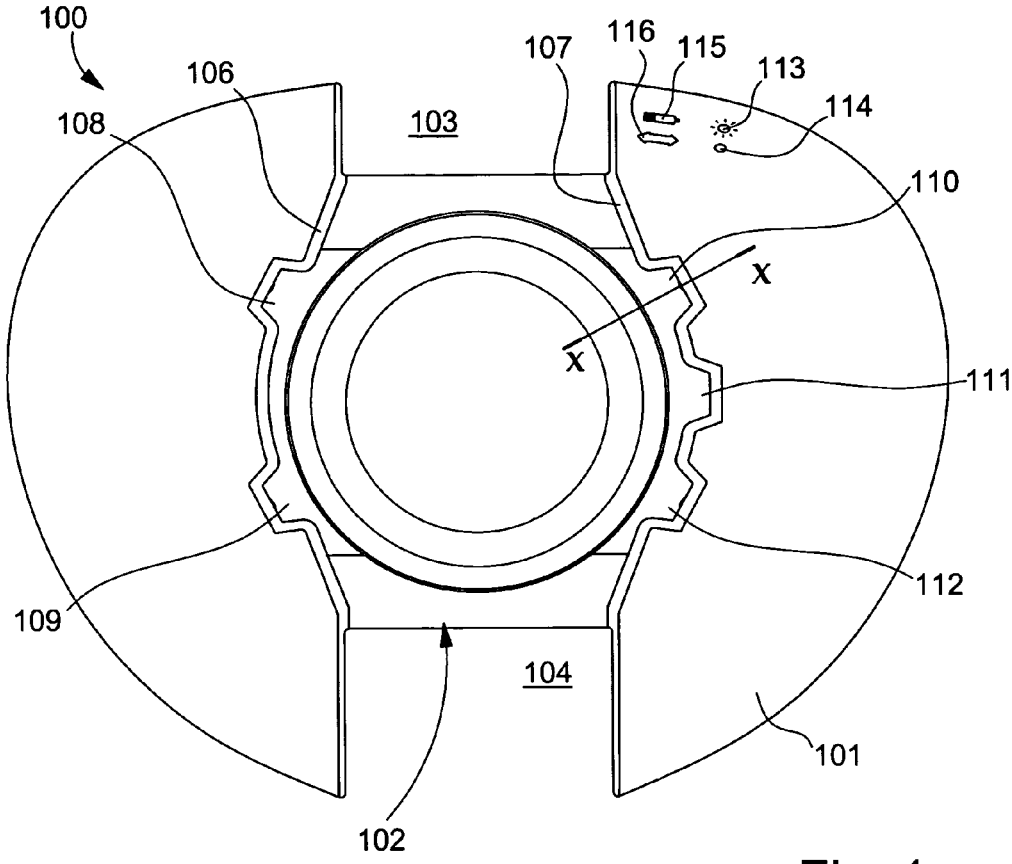
FIG. 1*a* shows a top view of an adaptor according to a first preferred embodiment of the invention.

FIG. 1*a* shows a top view of an adaptor designated as a whole by the reference numeral 100, according to a first preferred embodiment of the invention. As mentioned previously, this adaptor 100 advantageously takes the form of a support 101 for a wristwatch, defining on its top part a pattern cavity 102 dimensioned to receive the wristwatch (shown in FIG. 1*b*). A pattern cavity means: a cavity preventing a movement or rotation in the main plane of the portable instrument, once positioned in the cavity.

According to the illustrated example, support 101 is provided with two apertures 103 and 104 arranged on either side of pattern cavity 102, so as to allow the watch bracelet to pass through. The pattern cavity preferably has a circular excavated portion 105 in which the back cover-middle part of the wristwatch is fitted. Pattern cavity 102 also has two side surfaces 106 and 107 respectively including two and three housings, respectively designated by the reference numerals 108, 109, 110, 111 and 112, each intended to receive one of the five control members of the wristwatch. It will be noted however that the number of control members with which the wristwatch is provided is given solely by way of example, as is the number of corresponding housings provided in pattern cavity 102, the latter having to include at least one housing capable of receiving the control member or members of the watch.

Each of housings 108, 109, 110 and 112, corresponding to a control member configured to fulfil two functions, has electric contact means for assuring the electric connection between adaptor 100 and the wristwatch, detailed example embodiments of said contact means being given hereinafter.

It will also be noted that support 101 comprises the electrical charging device and/or the electronic communication interface for communicating with a personal computer (both not shown in this Figure).

Preferably, adaptor 100 is provided with means for indicating its operating state. Thus, for example, an indication relating to the state of charge of the watch's accumulator can be provided by means of a first light emitting diode 113 in a first colour when the watch is charging and a second diode in a second colour to indicate that charging has finished (the watch being positioned on the support). By way of alternative, a single diode 113 can be provided passing into a flashing or off mode to indicate the end of charging, or even a two-colour diode. An indication relating to the state of data transfer can be provided by means of a diode 114, which is switched on when data is being exchanged between the computer and the watch via the communication interface of the adaptor (the watch being positioned on the adaptor).

For an adaptor capable of acting both as charger and communication interface, it is proposed to affix a sign opposite each of indicating diodes 113 and 114, representing the corresponding operating mode. In the example shown, the sign 115 corresponding to the charging mode is a battery and the sign 116 corresponding to the data transfer mode is a two-directional arrow. In the following description, adaptor 100 will be presented as acting both as a charger and as communication interface. However, it will be understood that the following description is also applicable to an adaptor capable of performing only one of these functions.

Figure 1B:
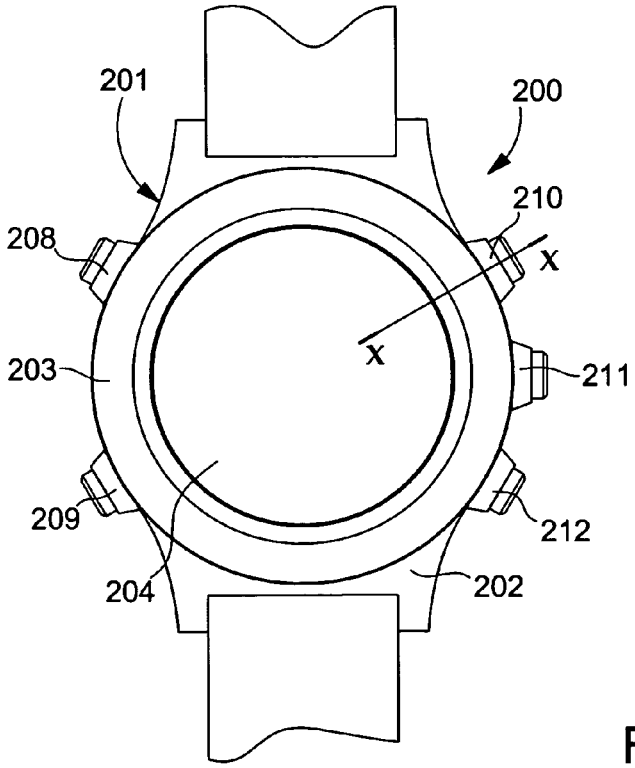
FIG. 1*b* shows a top view of a portable electronic instrument shown advantageously here in the form of a wristwatch including a plurality of control members of the push-button type, compatible with the adaptor of FIG. 1*a* according to the first embodiment of the invention.

FIG. 1*b* shows an overall plan view of a wristwatch intended to cooperate with the adaptor of FIG. 1*a*. The wristwatch is designated as a whole by the reference numeral 200. It includes, in particular, a case 201 delimited in this example by a bottom part 202 forming the middle part and back cover, which will be fitted as previously mentioned into excavated portion 105 made in pattern cavity 102 of the adaptor, and a top part 203 forming a bezel, which also carries a glass 204. Bezel 203 is fitted onto middle part 202 in a conventional manner, a sealing gasket being inserted between these elements in order to seal case 201.

In this example, five control members of the push-button type pass through middle part 202, respectively designated by the reference numerals 208, 209, 210, 211 and 212. It goes without saying that this example is given solely by way of illustration and that, in order to implement the present invention, the instrument need only include at least one control member configured as will be described hereinafter. The five control members 208 to 212 together form a user interface with which the user can interact to select the various functions of wristwatch 200.

Control members 208 to 212 are placed laterally here on middle part 202 at typical locations for a wristwatch, namely substantially at 2 o'clock, 3 o'clock, 4 o'clock, 8 o'clock and 10 o'clock respectively. It goes without saying that control members 208 to 212 could be arranged at other locations.

In this example, control members 208, 209, 210 and 212 have a similar configuration, control member 211 also however configured like a conventional control member to fulfil solely its control role. This control member 211 could also be configured like a conventional stem-crown for setting the time of the watch.

According to a preferred embodiment, two control members 208 and 209 are used to be connected to the two charging terminals of the accumulator when they are in the pushed-in position. Two other members 210 and 212 are used for establishing communication with a two-wire bus, one acting as clock terminal and the other as data terminal, also when they are in the pushed-in position. The last member 211 remains unused. Of course, this latter member could be used if needed.

Figure 2A:
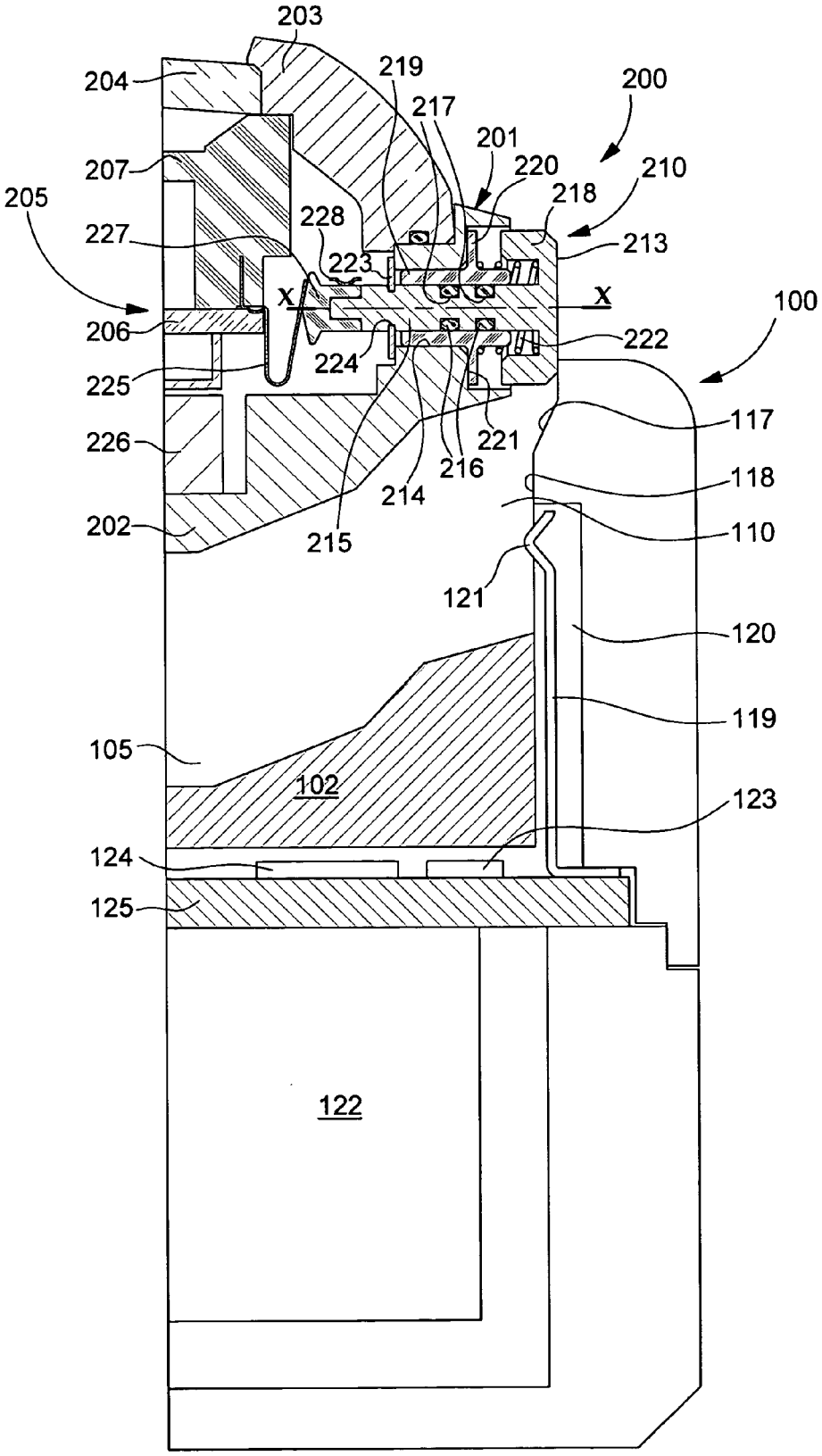
FIG. 2*a* shows a partial cross-sectional view of FIGS. 1*a* and 1*b*, along the axis of actuation X—X of a control member, prior to introduction of the portable instrument into the adaptor pattern cavity.
Figure 2B:
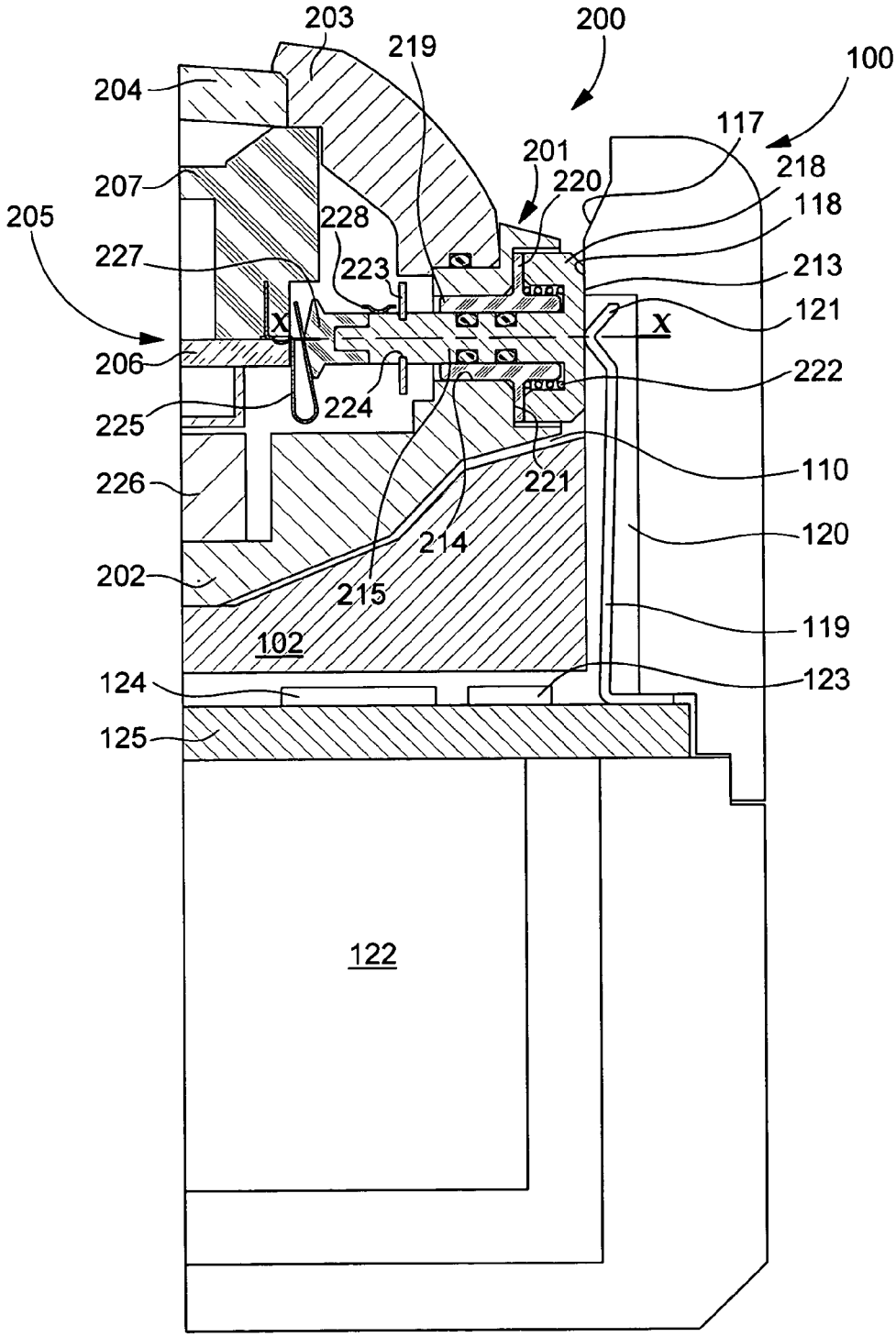
FIG. 2*b* is a cross-sectional view of FIGS. 1*a* and 1*b*, along the axis of actuation X—X of a control member, after introduction of the portable instrument into the adaptor pattern cavity.

FIGS. 2*a* and 2*b* each show a partial cross-sectional view of FIGS. 1*a* and 1*b*, taken at control member 210 along its axis of actuation designated X—X and of housing 110 corresponding to this member, showing watch 200 respectively before and after its introduction into cavity 102 of adaptor 100.

First of all, we will examine adaptor 100. The latter is essentially formed by support 101 of wristwatch 200 having a pattern cavity 102 dimensioned to receive said wristwatch. The cross-section of adaptor 100 is shown at housing 110, a preferred embodiment example of which is described hereinafter.

Housing 110 includes, in its top part, guide means made in the form of a flared portion 117 for bringing watch 200 and, in particular, the corresponding control member 210, into position. It will be noted in this regard that the side walls 106 and 107 of pattern cavity 102 advantageously also have a flared portion for guiding the watch when it is introduced into the pattern cavity.

According to an embodiment that is not shown, flared portion 117 has at its bottom end a shoulder acting as retaining means for control member 210 and thus the watch once introduced into pattern cavity 102. In order to implement this variant, it is important to ensure, on the one hand, that control member 210 is in its pushed-in position (i.e. the electric connection is established), once watch 200 has been introduced into pattern cavity 102, while ensuring on the other hand, that sufficient play is left for the travel of control member 210 in order for watch 200 to be released without excessive mechanical stress.

Flared portion 117 is followed by a support surface 118 against which the top part of the thrust face 213 of control member 210 abuts, when watch 200 is in pattern cavity 102. The depth of housing 110, i.e. the distance from lateral surface 107 of the pattern cavity (not visible in this cross-section) to support surface 118, is dimensioned such that, when the watch is introduced into the pattern cavity, control member 210 is in its pushed-in position.

It will be noted in this regard that housings 108, 109, 110 and 112 corresponding to control members 208, 209, 210 and 212, are arranged such that the support surface 118 of each of the housings also acts as a retaining surface for the watch in the pattern cavity, for the case in which the control members are provided with return means 222 from their pushed-in position to their non pushed-in position. Indeed, in this case, each support surface compensates for the action of the control member that abuts on the opposite support surface.

Figure 3:
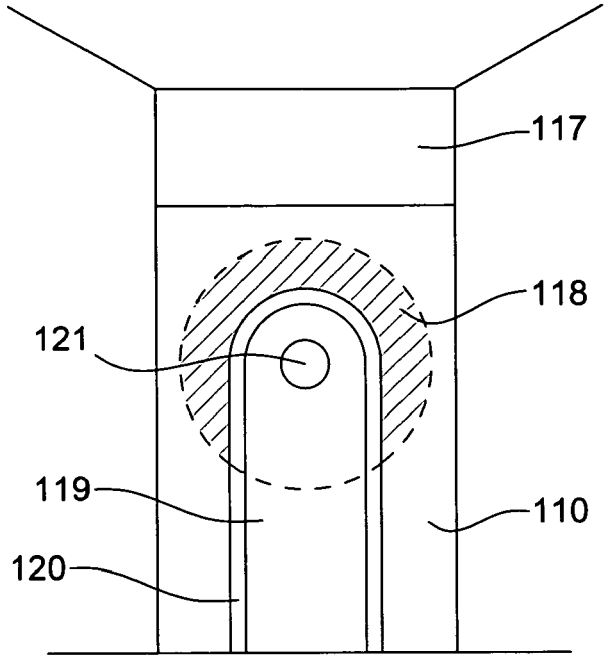
FIG. 3 is a front view of one of the housings of the adaptor pattern cavity according to a particular variant.

Underneath support surface 118, in correspondence with the bottom part of thrust face 213 of control member 210 after the watch has been introduced into the pattern cavity, electric contact means 119 are arranged in a cavity 120 made in the bottom part of housing 110. These electric contact means are preferably made by means of a flexible metallic strip 119 having an opposite return force to that of control member 210. In the zone facing the bottom part of thrust face 213 of the control member, this strip 119 has a bent portion 121 that projects slightly with respect to the vertical plane defined by support surface 118. Alternatively, this bent portion can be replaced by a stamped boss-shaped portion as shown in FIG. 3. This arrangement of strip 119 in housing 110 not only ensures a proper electrical contact with the conductive part of the control member that is accessible from the outside, for example thrust face 213, but also prevents the application of strong mechanical stress on strip 119 when the watch is introduced into the pattern cavity.

FIG. 3 shows a front view of housing 110 according to a preferred variant. Flared portion 117 can be seen again, under which is located support surface 118 acting as a retaining surface for the corresponding control member of the portable instrument. The dotted lines surrounding support surface 118 illustrate thrust surface 213 of the control member when the instrument is placed in the pattern cavity. Strip 119 is positioned in cavity 120. According to this variant, this electrically conductive strip has a stamped boss-shaped portion 121, or equally, a bent portion as mentioned previously in FIGS. 2*a* and 2*b*, forming the electrical contact with thrust surface 213 of the control member.

According to another variant of housing 110 (not shown), support surface 118 comes into contact with the whole of thrust face 213 of control member 210, bringing the control member into its pushed-in position when watch 200 is introduced into pattern cavity 102. In order to form the electric connection, the support surface is then covered with a metallisation layer acting as electric contact means. However, according to this variant, strong friction is imposed between thrust face 213 of the control member and the metallisation layer, which can alter the contact quality after repeated use.

With reference again to FIGS. 2*a* and 2*b*, the bottom of the pattern cavity is again showing advantageously having, as previously mentioned, an excavated portion 105, whose cross-section lines are preferably similar to those of back cover-middle part 202 of the watch, which enables the latter to be fitted in a stable manner when it is introduced into the pattern cavity. However, it will be understood that the bottom of the pattern cavity can have other cross-section lines, insofar as at least one stop surface is provided to retain the vertical travel of the watch such that the control members are in contact with the electric contact means arranged in the housings.

The adaptor support 101 further includes elements for performing the charger and/or communication interface function. In order to perform the charger function, adaptor 100 is conventionally provided with a transformer 122 capable of being connected to the mains with which a current monitoring circuit 123 will preferably be associated in order to prevent overloading the accumulator of the watch. By way of alternative, the transformer can form part of network connector of the power supply cable as is well known form small portable apparatus connected to the mains.

In order to perform the communication interface function, the adaptor is provided with an interfacing module 124 between a communication bus and a (parallel, serial . . . ) communication port of a personal computer. One could use, for example, a two-wire bus, where a transmission line is used for transmitting data signals and where the other line is used to transmit data signals. Alternatively, the first line could be used for transmitting signals from the portable instrument and the other line for receiving signals from the exterior of the instrument. Each of these transmission lines is connected to the communication module of the watch via a control member of the latter. A solution requiring the use of a USB bus and a USB communication port has the advantage of being able to use the USB bus power supply for carrying out the charging operations, no adaptor to the external power grid then being necessary.

Electric contact means 119 arranged in housing 110 are electrically connected to transformer 122 and/or communication interface 124, for example by welding, via a printed circuit board or PCB 125 supporting these elements.

We will now examine wristwatch 200, and more particularly control member 210. Control member 210 is mounted so as to be mobile in an assembly orifice 214 arranged in middle part 202 so as to have a translation travel along axis of actuation X—X. Control member 210 can be actuated by pressure, like a conventional push-button, to be brought from a position called the non pushed-in position, i.e. before its introduction into pattern cavity 102 of the adaptor, as illustrated in FIG. 2*a*, to a position called the pushed-in position, i.e. after its introduction into pattern cavity 102 of the adaptor, illustrated in FIG. 2*b*.

Control member 210 is made up mainly of a stem 215, of elongated shape, made of an electrically conductive material, advantageously of metal. This stem 215 preferably, but not exclusively, has a cylindrical shape and passes right through middle part 202. A first end of stem 215 thus extends inside the cavity formed by middle part 202 whereas the second end of stem 215 extends outside middle part 202. Sealing is assured in a conventional manner by one or several O-ring joints 216 housed in one or several grooves 217 arranged on stem 215.

On its second end, stem 215 ends in a head 218 of larger diameter having an external thrust head 213. In this example, stem 215 and head 218 of the control member are made in one electrically conductive piece, thus forming electric contact means accessible from outside the case. In order to fulfil the desired electric signal transmission function, it will be understood that in any case electric access should be assured to stem 215 from the exterior.

Middle part 202 is also made, according to a variant, of an electrically conductive material, stem 215 being consequently insulated from middle part 202 by an insulating sleeve 219. In this preferred example, middle part 202 is also brought, during normal use independent from the adaptor, to a determined electrical potential, here the earth potential of the portable instrument. Insulating sleeve 219 advantageously has a generally tubular shape with a shoulder 220 arranged to abut, from outside middle part 202, on a corresponding shoulder 221 arranged in assembly orifice 214. This insulating sleeve 219 is thus introduced into assembly orifice 214 from the exterior and is preferably secured to middle part 202, for example by being driven in, screwed in or bonded.

Elastic return means 222, formed in this example of a helical spring, is placed between shoulder 220 of insulating sleeve 219 and head 218 of the control member. When pressure is applied onto the control member, return means 222 is thus compressed between shoulder 220 and head 218 as illustrated in FIG. 2*b*, thus exerting a return force tending to return the control member 210 from its pushed-in position to its non-pushed-in position, illustrated in FIG. 2*a*. It will be noted that shoulder 220 of the insulating sleeve also assures that head 218 of the control member, which is conductive here, does not come into contact with middle part 202.

The control member also includes a retaining element 223 adapted to retain stem 215 of the control member axially. For this purpose, retaining element 223 is secured to stem 215 and is placed on the inner side of middle part 202 in order to act against the action of return means 222, which tends to extract the control member from its assembly orifice 214. Retaining element 223 is advantageously configured like a traditional retaining key, which is introduced into a groove 224 arranged on stem 215. This retaining element 223 is also made of an electrically conductive material.

It will also be noted that middle part 202 defines an inner cavity which is occupied, in a conventional manner, by an electronic communication module 205 (partially shown in FIG. 2*a*) including in particular a printed circuit board, or PCB 206, carrying various electrical and electronic components (not shown) including a data processing unit (for example a microcontroller or a microprocessor), storage means (for example EEPROM, FLASH or similar) and other components for implementing the functions of wristwatch 200. Horological components (time base, frequency divider, analogue and/or digital display means, etc.) are in particular conventionally provided in this example to fulfil various horological functions, including in particular the time display. Reference 207 indicates an optional element forming a spacer arranged on the top face of PCB 206 and which carries in particular the display means of the electronic instrument. An electric energy source 226 has also been partially shown, particularly for powering the aforementioned electronic module 205. This may be a conventional battery or a rechargeable accumulator (which can for example be recharged via at least one of the control members as already mentioned).

Thus, in this first embodiment, it will thus be understood that in FIG. 2*a*, i.e. in the non pushed-in position, retaining element 223 abuts middle part 202, at the periphery of assembly orifice 214. Consequently, in the non pushed-in position, the control member is earthed, stem 215 being electrically connected to middle part 202.

However, in FIG. 2*b*, i.e. in the pushed-in position, stem 215 is no longer electrically connected to middle part 202 because of the axial movement of retaining element 223, which accompanies the movement of stem 215, making it possible for electric signals to be transmitted via stem 215, which is then electrically connected to communication module 205 of the watch. It will be noted that in this pushed-in position, the control member is capable of operating like a conventional push-button, which is achieved by means of a first conventional electric contact and as an electric signal transmission member, which is achieved by means of a second electric contact. An example embodiment of these two electric contacts is detailed hereinafter.

The first electric contact is conventionally realised in the form of an electric contact strip 225 including a base secured to electronic communication module 205 (this base is held here between PCB 206 and spacer 207) and a flexible extension, which cooperates with the end of stem 215, this end being electrically insulated from contact strip 225 by an insulating sheath 227, which can be made in a similar material to that of insulating sleeve 219. The flexible extension of contact strip 225 is arranged to be brought conventionally into contact with the other part of the first electric contact (not shown in FIGS. 2*a* and 2*b*). In the present case, it is a metallisation formed on the edge of PCB 206. Thus, in the pushed-in position, the flexible extension of contact strip 225 comes into contact with the metallisation on PCB 206.

The second electric contact is realised owing to retaining element 223 secured to stem 215 and to a second electric contact 228 arranged tangentially to stem 215 in proximity to its end covered by insulating sheath 227. This electric contact strip 228 is itself held by its base between PCB 206 and spacer 207. Consequently, in the non pushed-in position (FIG. 2*a*), electric contact strip 228 is in contact with insulating sheath 227 and in the pushed-in position (FIG. 2*b*) electric contact string 228 is in contact with stem 215.

In order to disassociate the use of control members 208 to 212 in normal operating mode and in electric signal transmission operating mode, various solutions can be adopted. One advantageous solution is to provide automatic detector, for example by communication module 205, of simultaneous pressure on all of the control members for a predetermined time period, which essentially occurs when the electronic instrument is placed on adaptor 100. Alternatively, a communication mode actuation function could be predefined in the range of functions of the electronic instrument and this function could be called up and selected by means of the user interface of the instrument. Alternatively again, the presence of the portable electronic instrument on the adaptor can be detected through setting one of the transmission lines to a determined potential via one of the control members.

Figure 4:
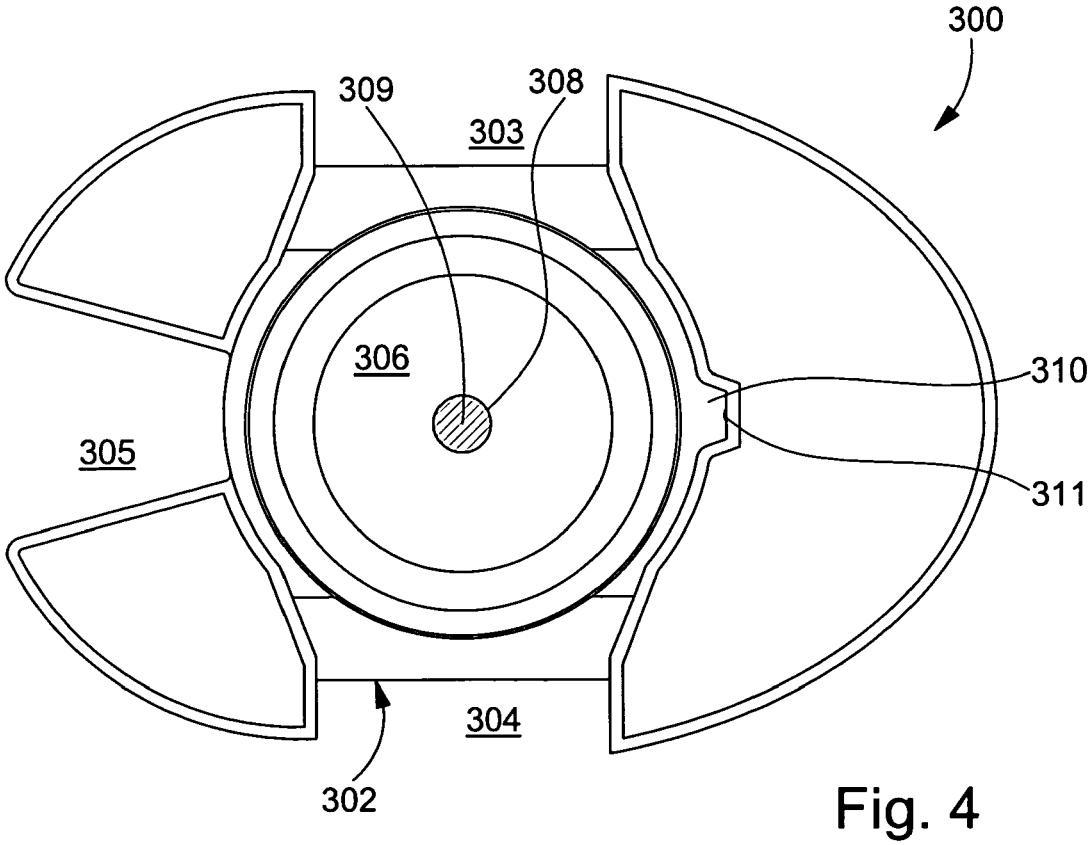
FIG. 4 is a top view of an adaptor according to a second embodiment of the invention.

FIG. 4 shows a top view of an adaptor designated as a whole by the reference numeral 300, according to a second embodiment of the invention. This adaptor 300 takes the form of a support 301 for a wristwatch defining on its top part a pattern cavity 302 dimensioned to receive the wristwatch (not shown). According to the example illustrated, support 301 is provided with first and second apertures 303 and 304 arranged on either side of pattern cavity 302 so as to allow the watch bracelet pass through and a third side aperture 305 capable of receiving a connecting element with an external communication unit, such as the mains or a personal computer, depending upon whether the adaptor is used respectively as a charger or communication interface.

Pattern cavity 302 preferably has a circular excavated portion 306 into which the back cover-middle part of the wristwatch is fitted. An aperture 308 is made in the bottom of this excavated portion, through which electric contact means 309 project so as to establish an electric connection between the communication interface of the adaptor and a terminal of the accumulator or the communication module of the watch via the metal back cover of the latter. Pattern cavity 302 also has a housing 310 similar to that described with reference to FIGS. 2*a* and 2*b*. It will be noted that, electric connect means 311, preferably in the form of a flexible conductive strip, are likewise arranged in the housing. This housing 310 is preferably situated in a position corresponding to 3 o'clock on the wristwatch that will be introduced into the pattern cavity.

It will thus be understood the charger or respectively the communication interface function can be achieved by using the control member and the back cover of the watch as accumulator charging terminals or respectively as data transfer terminals.

It will be understood that various modifications and/or improvements obvious to those skilled in the art can be made to the embodiments described in the present description without departing from the scope of the invention defined by the annexed claims. In particular, the present invention is not limited solely to use in a wristwatch but applies to any other application in a portable electronic instrument.

Instead of control members of the push-button type, one could also use any other type of control member insofar as it has two distinct positions respectively allowing coupling or uncoupling of the input/output terminals. One may, for example, think of a stem-crown having at least two distinct axial positions. The movement of the connecting element could also follow a different movement to a translation. One may, for example, think of a control member in which the mobile element undergoes a rotational movement.

It will have been understood, finally, that the nature of the electronic communication unit with which one wishes to establish a connection via input/output terminals can vary. It may be a processor unit as described, solely a memory unit or a unit whose operating features one wishes to adjust (for example a frequency divider circuit, a sensor, etc.).

What is claimed is:

1. A system for transmitting electric signals between a portable electronic instrument and an adaptor, wherein it includes:

the portable electronic instrument including a case containing an electronic module controlled via at least a first control member having first electric contact means accessible from the exterior of the case, said first control member being able to occupy a first non pushed-in position in which no electric contact is established between the first electric contact means and the electronic module and a second pushed-in position in which an electric connection is established between the first electric contact means and the electronic module, and the adaptor being adapted to establish a connection with said instrument to allow transmission of electric signals, this adaptor including a support having a pattern cavity dimensioned to receive said instrument, the pattern cavity including at least a first recess in which second electric contact means are arranged, said first recess being dimensioned to receive said first control member, such that, on the one hand, said first control member is brought into the pushed-in position and, on the other hand, said first and second electric contact means are brought into contact, when the instrument is placed in the pattern cavity.

2. The transmission system according to claim 1, wherein the electronic module is powered by a rechargeable accumulator having first and second charging terminals, wherein the instrument includes first and second control members respectively connected, in their pushed-in position, to one and the other of the two charging terminals, wherein the adaptor includes charging means and wherein the pattern cavity includes first and second recesses corresponding to said first and second control members, establishing, when the instrument is placed in the pattern cavity, an electric connection between said accumulator and said charging means to charge the accumulator.

3. The transmission system according to claim 1, wherein the instrument includes first and second control members connected in their pushed-in position to said electronic module, wherein the adaptor includes a communication interface between the electronic module of the instrument and an external communication unit and wherein the pattern cavity includes first and second recesses corresponding to said first and second control members, establishing an electrical connection between said electronic module and the external communication unit for transmitting data from and/or to the instrument.

4. The transmission system according to claim 1, wherein the electronic module is powered by a rechargeable accumulator having first and second charging terminals, wherein the instrument includes first and second control members respectively connected in their pushed-in position to one of the charging terminals, and third and fourth control members connected in their pushed-in position to the electronic module, wherein the adaptor includes charging means and a communication interface between the electronic module of the instrument and an external communication unit and wherein the pattern cavity includes first, second, third and fourth recesses corresponding to said control members, when the instrument is placed in the pattern cavity, a first electric connection between said accumulator and said charging means for charging the accumulator and a second electric connection between said electronic module and the external communication unit for transmitting data from and/or to the instrument.

5. The transmission system according to claim 1, wherein the instrument includes means for deactivating the usual functions of the control members when the instrument is placed in the pattern cavity.

6. An adaptor adapted for establishing an electric connection with a portable electronic instrument and allowing transmission of electric signals, said instrument being controlled via at least a first control member having first electric contact means accessible from the exterior of the instrument, said first control member being capable of occupying a first non pushed-in position and a second pushed-in position, wherein the adaptor includes a support having a pattern cavity dimensioned to receive said instrument, the pattern cavity including at least one recess in which second electric contact means are arranged, said recess being dimensioned to receive said first control member, such that, on the one hand, said first control member is brought into the pushed-in position and, on the other hand, said first and second electric contact means are brought into contact, when the instrument is placed in the pattern cavity.

7. The adaptor according to claim 6, wherein it said housing has a support surface against which at least a port of a thrust surface of the control member abuts when the instrument is placed in the pattern cavity so as to bring the control member into the pushed-in position and wherein the second electric contact means are made in the form of a metallisation layer affixed to said support surface so as to contact an electrically conductive part of said thrust surface.

8. The adaptor according to claim 6, wherein the pattern cavity has at least one stop surface for retaining the vertical travel of the instrument such that the control member is in contact with the second electric contact means.

9. The adaptor according to claim 6, wherein the adaptor is a support for a wristwatch.

10. The adaptor according to claim 6, for a portable electronic instrument, wherein said first control member includes return means from the second pushed-in position to the first non pushed-in position and wherein the second electric contact means are made in the form of a flexible metal strip having an opposite return force to that of the control member.

11. The adaptor according to claim 10, wherein said recess has a support surface against which at least one part of a thrust surface of the control member abuts when the instrument is placed in the pattern cavity so as to bring the control member into a pushed-in position.

12. The adaptor according to claim 11, for a portable electronic instrument wherein the first electric contact means include said thrust surface, wherein, under the support surface, said recess has a cavity in which said strip is arranged, which has a bent portion or boss-shaped stamped portion projecting with respect to the vertical plane defined by the support surface and wherein said bent portion is in contact with said thrust portion when the instrument is placed in the pattern cavity.

13. The adaptor according to claim 11, for a portable electronic instrument, including at least four control members diametrically opposite each other in pairs, wherein the pattern cavity includes at least four recesses corresponding to the control members, and wherein the support surface of each of these recesses also acts as a surface for retaining the control member abutting the diametrically opposite support surface.

14. The adaptor according to claim 6, wherein said recess includes in its top part guide means for bringing the control member into position.

15. The adaptor according to claim 14, wherein the guide means are made in the form of a flared portion.

16. The adaptor according to claim 15, wherein, at its lower end, said flared portion has means for retaining the control member when the instrument is placed in the pattern cavity.

17. The adaptor according to claim 6, wherein the bottom of the pattern cavity includes an excavated portion in which the back cover of the instrument is fitted.

18. The adaptor according to claim 17, for a portable electronic instrument, having a metal back cover, wherein an aperture is made in said excavated portion, through which third electric contact means project so as to establish an electric contact with the back cover of the instrument.

* * * * *